US011521816B2

(12) United States Patent
Sunohara et al.

(10) Patent No.: US 11,521,816 B2
(45) Date of Patent: Dec. 6, 2022

(54) RELAY WITH A YOKE HAVING PROTRUSION FOR CAULKING AND BULGE PORTION ADJACENT TO PROTRUSION

(71) Applicant: Fujitsu Component Limited, Tokyo (JP)

(72) Inventors: Takaki Sunohara, Tokyo (JP); Yuki Kakoiyama, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 17/125,623

(22) Filed: Dec. 17, 2020

(65) Prior Publication Data

US 2021/0193418 A1 Jun. 24, 2021

(30) Foreign Application Priority Data

Dec. 19, 2019 (JP) ..... JP2019-229125

(51) Int. Cl.

| | |
|---|---|
| ***H01H 50/36*** | (2006.01) |
| ***H01H 50/04*** | (2006.01) |
| ***H01H 50/44*** | (2006.01) |
| ***H01H 50/28*** | (2006.01) |
| ***H01H 50/58*** | (2006.01) |
| *H01H 50/14* | (2006.01) |
| *H01H 50/24* | (2006.01) |
| *H01H 50/60* | (2006.01) |

(52) U.S. Cl.

CPC ..... *H01H 50/44* (2013.01); *H01H 50/041* (2013.01); *H01H 50/28* (2013.01); *H01H 50/36* (2013.01); *H01H 50/58* (2013.01); *H01H 50/14* (2013.01); *H01H 50/24* (2013.01); *H01H 50/60* (2013.01); *H01H 2050/446* (2013.01)

(58) Field of Classification Search

CPC ..... H01H 50/44; H01H 50/041; H01H 50/28; H01H 50/36; H01H 50/58; H01H 50/14; H01H 50/24; H01H 50/60; H01H 2050/446; H01H 50/042; H01H 50/16; H01H 50/54; H01H 50/56

See application file for complete search history.

(56) References Cited

U.S. PATENT DOCUMENTS

| | | | |
|---|---|---|---|
| 4,683,358 | A | 7/1987 | Dittmann |
| 5,903,200 | A | 5/1999 | Ogawa et al. |
| 6,337,614 | B1 | 1/2002 | Tsutsui |
| 6,590,480 | B2 | 7/2003 | Matsuda |
| 6,784,773 | B2 | 8/2004 | Tsutsui et al. |
| 6,794,966 | B2 | 9/2004 | Thrush et al. |

(Continued)

FOREIGN PATENT DOCUMENTS

| | | | |
|---|---|---|---|
| EP | 2889886 | A1 | 7/2015 |
| EP | 3734634 | A1 | 11/2020 |

(Continued)

*Primary Examiner* — Bernard Rojas
(74) *Attorney, Agent, or Firm* — Shumaker & Sieffert, P.A.

(57) ABSTRACT

Provided is a relay having a structure for preventing deformation of a movable spring when it is caulked. A yoke of the relay has a protrusion for caulking inserted in the movable spring, and a bulge portion adjacent to the protrusion and having a height lower than a height of the protrusion. By providing the bulge portion to the yoke, the dimensional change in the caulking direction of the movable spring when the movable contact is caulked can be reduced.

5 Claims, 6 Drawing Sheets

(56) References Cited

U.S. PATENT DOCUMENTS

| | | | | |
|---|---|---|---|---|
| 7,135,946 | B2 | 11/2006 | Hoffmann | |
| 9,324,525 | B2 | 4/2016 | Yamauchi et al. | |
| 10,403,460 | B2 | 9/2019 | Daikoku et al. | |
| 11,043,347 | B2 | 6/2021 | Sunohara et al. | |
| 2011/0121926 | A1 | 5/2011 | Kojima et al. | |
| 2013/0241679 | A1 | 9/2013 | Kobayashi | |
| 2014/0062626 | A1 | 3/2014 | Saito et al. | |
| 2016/0027602 | A1* | 1/2016 | Hasegawa ..... | H01H 51/2236 335/189 |
| 2017/0092450 | A1 | 3/2017 | Sunohara et al. | |
| 2017/0345597 | A1 | 11/2017 | Sasaki et al. | |
| 2021/0193418 | A1 | 6/2021 | Sunohara et al. | |
| 2021/0193419 | A1 | 6/2021 | Sunohara et al. | |

FOREIGN PATENT DOCUMENTS

| | | | | | |
|---|---|---|---|---|---|
| JP | S63135744 | U | * | 9/1988 | ..... H01H 50/24 |
| JP | 2006059702 | A | | 3/2006 | |
| JP | 2011081961 | A | | 4/2011 | |
| JP | 2012142208 | A | | 7/2012 | |
| JP | 2012142210 | A | | 7/2012 | |
| JP | 2014049315 | A | | 3/2014 | |
| JP | 2015125985 | A | | 7/2015 | |
| JP | 2017068926 | A | | 4/2017 | |

* cited by examiner

RELAY WITH A YOKE HAVING PROTRUSION FOR CAULKING AND BULGE PORTION ADJACENT TO PROTRUSION

CROSS-REFERENCE TO RELATED APPLICATIONS

This application is based on and claims priority to Japanese Patent Application No. 2019-229125, filed on Dec. 19, 2019, the entire contents of which are incorporated herein by reference.

TECHNICAL FIELD

The present disclosure relates to a relay.

BACKGROUND

An electromagnetic relay (referred to generally as a "relay") is configured to apply a voltage to a coil so as to open/close a contact. There are some relays having a movable terminal moved by applying the voltage to the coil and two fixed terminals, wherein the movable terminal contacts one fixed terminal when the voltage is applied, and contacts the other fixed terminal when the voltage is not applied.

SUMMARY

There are some relays, wherein a protrusion for caulking is formed on a yoke, a movable terminal is fixed to the yoke by inserting the protrusion into a movable spring, and then by caulking the protrusion. In such relays, the movable spring formed from a relatively thin metal plate may be deformed by a pressing force of a punch, etc., when the caulking.

One aspect of the present disclosure is a relay comprising: an electromagnet having a coil wounded on a winding frame and an iron core positioned in the winding frame; an armature actuated by activation of the electromagnet; a movable terminal having a movable spring attached to the armature and a movable contact attached to the movable spring; a fixed contact opposed to the movable contact; and a yoke to which the movable spring is caulked, wherein the yoke has a protrusion for caulking inserted in the movable spring, and a bulge portion adjacent to the protrusion and having a height lower than a height of the protrusion.

DETAILED DESCRIPTION

Figure 1:
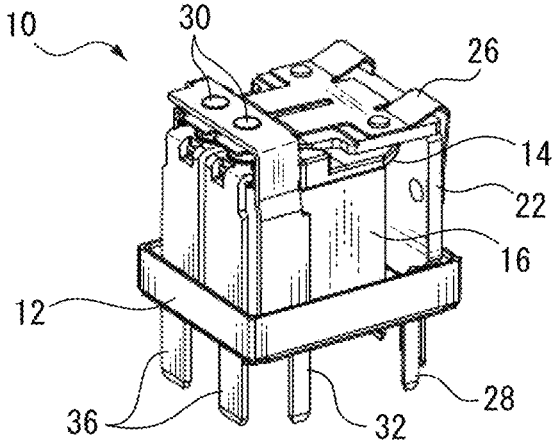
FIG. 1 is a perspective view of a relay according to an embodiment.
Figure 2:
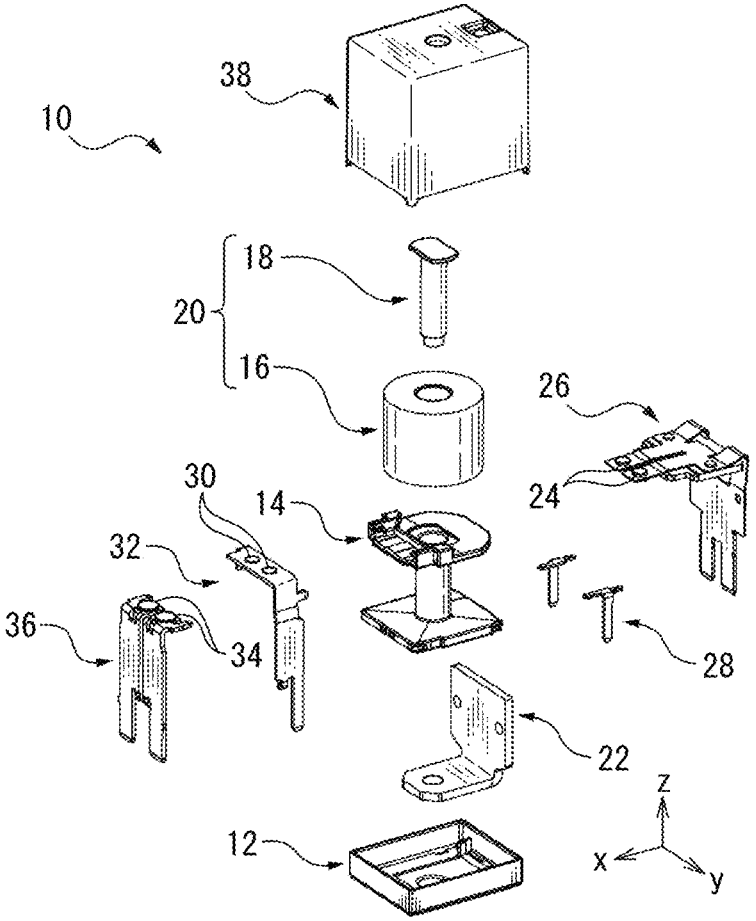
FIG. 2 is an exploded perspective view of the relay.

FIG. 1 shows a relay according an embodiment, and FIG. 2 is an exploded perspective view of the relay. A relay 10 has a base 12 capable of being mounted on a not shown printed circuit board, etc.; an electromagnet 20 having a coil winding 16 wound on a winding frame 14 and an iron core 18 positioned in the winding frame 14; a yoke 22 having a generally L-shape and connected to one end of the iron core 18; a movable terminal 26 having two movable contacts 24 moved in a direction toward/away from the iron core 18 due to the activation of the electromagnet 20; and two coil terminals 28 attached to the winding frame 14 and respectively connected to the both ends of the winding 16.

The relay 10 has two fixed contacts opposed to the movable contacts 24, and a fixed terminal attached to the winding frame 14. In this embodiment, the relay has a first fixed terminal (break terminal) 32 with two fixed break contacts 30, and a second fixed terminal (make terminal) 36 with two fixed make contacts 34. The movable contact 24 contacts the break contact 30 when the electromagnet 20 is off, and contacts the make contact 34 when the electromagnet 20 is on. Since each of the movable terminal 26, the break terminal 32 and the make terminal 36 has the two contacts, the energization performance of the relay 10 is improved.

The relay 10 is fitted with the base 12, and has a cover 38 configured to contain the above components. In FIG. 1, the cover 38 is omitted.

In this embodiment, a height direction parallel to an axial direction of the iron core 18 is referred to as a z-direction, a width direction perpendicular to the z-direction is referred to as a y-direction, along which the two movable contacts 24 or the two fixed contacts 30 or 34 are arranged, and a front-back direction perpendicular to both the y- and z-directions is referred to as an x-direction.

Figure 3:
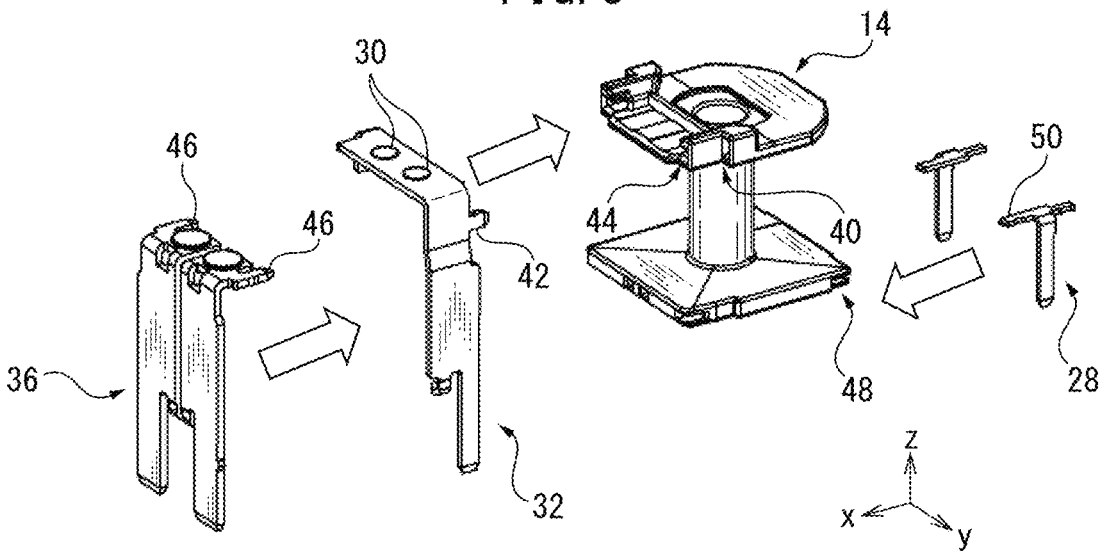
FIG. 3 is a view showing an attachment direction of a terminal.
Figure 4:
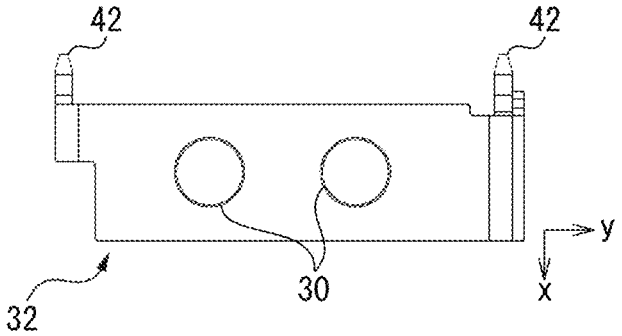
FIG. 4 is a top view of a break terminal.
Figure 5:
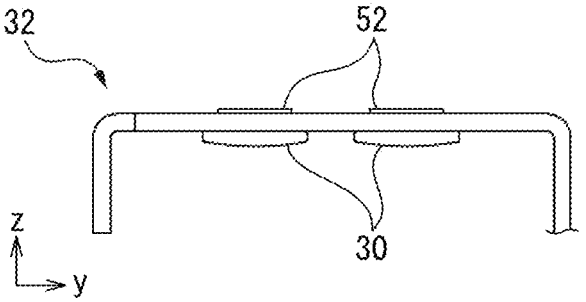
FIG. 5 is a side view of the break terminal.

FIG. 3 shows the attachment direction of each terminal relative to the winding frame 14. Although a fixed terminal is fixed by being inserted into a winding frame in the z-direction in a conventional relay, at least one of the fixed terminal 32 or 36 in the embodiment is fixed by being moved in a direction (in this case, the x-direction) intersecting the z-direction. The winding frame 14 has first insertion holes 40 which are formed on the both sides thereof in the y-direction and open in the x-direction, preferably, only in the x-direction. As shown in FIG. 4, the break terminal 32 has protruded first insertion portions 42 capable of being inserted into insertion holes 40 in the x-direction.

Similarly, the winding frame 14 has second insertion holes 44 which are formed on the both sides thereof in the y-direction and open in the x-direction, preferably, only in the x-direction. The make terminal 36 has protruded second insertion portions 46 capable of being inserted into insertion holes 44 in the x-direction.

The winding frame 14 may have third insertion holes 48 which are formed on the both sides thereof in the y-direction and open in the x-direction, preferably, only in the x-direction. The coil terminal 28 may have protruded third insertion portions 50 capable of being inserted into insertion holes 48 in the x-direction.

When the fixed terminal is inserted in the z-direction, the inserting direction of the terminal is almost the same as the direction of displacement of the movable contact. Therefore, if the fixed terminal is not assuredly fixed, the fixed terminal may be displaced in the moving direction of the movable contact, thereby the performance and characteristics of the relay may be varied. This phenomenon can occur especially during the manufacture of relays, such as when an intermediate inspection is performed before the cover is adhered to the terminal.

On the other hand, in the embodiment, even when the movable contact is moved, the fixed terminal is not moved in the moving direction of the movable contact, variations in the performance and characteristics of the relay can be suppressed.

All of the make terminal 36, the break terminal 32 and the coil terminal 28 may be inserted into the winding frame 14 in the x-direction. In this case, a splitting manner of a mold for resin molding the winding frame 14 can be simplified. It is preferable that each insertion portion be fixed in each insertion hole by press fitting.

As shown in FIG. 4, one first insertion portion 42 may be formed on each side in the y-direction, and the winding frame 14 may be provided with two first insertion holes 40 into which the two first insertion portions 42 are respectively inserted. Due to this, the break terminal 32 can be more assuredly fixed to the winding frame 14.

When the break terminal 32 is attached to the winding frame 14 from the x-direction, the winding frame 14 may become large depending on the position of the first insertion hole 40. Therefore, as shown in FIG. 3, by providing the first insertion portion 42 below the break contact 30 in the z-direction, it is not necessary to form the first insertion hole 40 at the upper end of the winding frame 14, thereby the height of the winding frame 14 can be reduced. As a result, the compact relay 10 having a low height is provided. This also applies to the make terminal 36.

When the break contact 30 is fixed to the break terminal 32 by caulking, a protrusion 52 by caulking is formed on the upper side of the break terminal 32 in the drawing. At this time, it is necessary to increase a clearance between the break terminal 32 and the cover 38 by an amount of protrusion of the protrusion 52, resulting in that the relay 10 may become larger in the height direction.

Therefore, the break contact 30 may be fixed to the break terminal 32 by welding or brazing. In this case, since the protrusion 52 is not formed, the clearance between the break terminal 32 and the cover 38 can be reduced, and the relay 10 can be downsized.

Figure 6:
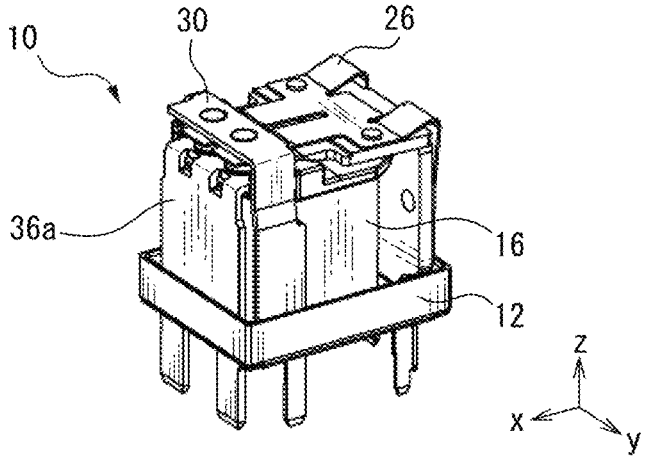
FIG. 6 is a view showing another example of a make terminal.

FIG. 6 shows another example of the make terminal. The make terminal 36 shown in FIGS. 1 to 3 is provided with one fixed contact 34 at each of the two terminal members. In FIG. 6, one metal plate to which two fixed contacts are attached is used as a make terminal 36*a*. By forming the make terminal 36*a* from one plate, the energization capacity can be increased as compared with the case where the two fixed terminals are formed from the different members.

Since the space where the coil 16 exists and the space where the contact exists can be separated by the make terminal 36*a*, even if water vapor is generated from the coil 16, it is possible to reduce the possibility that water vapor adheres to or enters the contact or its vicinity and condenses or freezes, which adversely affects the opening/closing operation of the contact.

Figure 7:
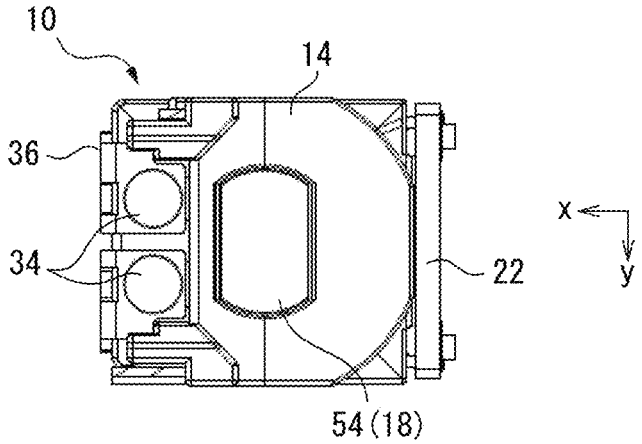
FIG. 7 is a top view showing a location of an iron core.

FIG. 7 is a view showing an arrangement example of the iron core 18, and the movable terminal and the break terminal are omitted. There is a relay in which the iron core is not positioned at the center of the winding frame, e.g., the iron core is eccentrically arranged toward the yoke side, thereby the distance between the iron core and the fixed contact is relatively large. In such a relay, the winding space cannot be effectively utilized. Therefore, as shown in FIG. 7, by arranging the iron core 18 at the center of the winding frame 14, the winding space within the relay 10 can be fully utilized.

Figure 8:
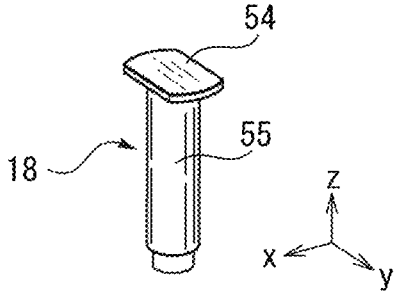
FIG. 8 is a perspective view of the iron core.

In the arrangement of FIG. 7, when the shape of a head 54 of the iron core 18 is a circular disk shape, the head 54 may interfere with the contact 34, etc., and the relay may become large in order to avoid the interference. Therefore, as shown in FIGS. 7 and 8, the area of the head 54 may be made larger than the radial cross section of a shaft portion 55 of the iron core 18, and the head 54 can be shaped as a track or an ellipse, etc., wherein, at least on the contact side, the distance from the center of the iron core 18 to the peripheral edge of the head 54 is shorter than the other sides. Due to this, as shown in FIG. 7, the iron core 18 and the contact 34 can be brought closer to each other, and the size of the relay in the x-direction can be reduced. The head 54 may have a shape in which only the distance from the center to the peripheral edge on the contact side is shorter than the others, for example, a part of the circle may be cut out in a straight line. However, in such a configuration, it is necessary to consider the angle of the iron core 18 at the time of assembly. Therefore, as shown in the drawing, it is preferable that the shape of the head 54 is point-symmetrical of, for example, 180 degrees.

Figure 9:
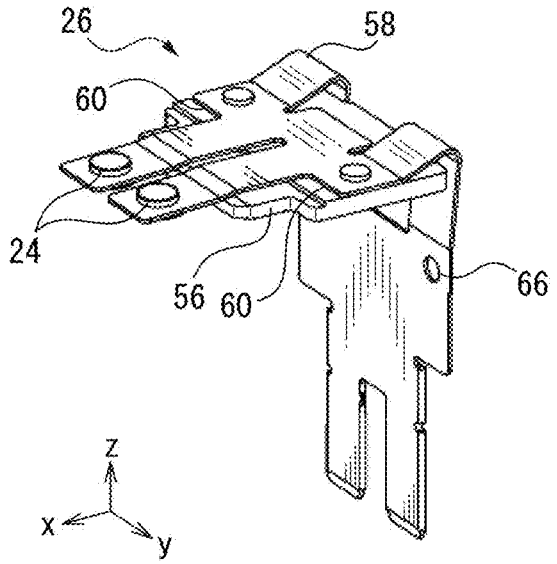
FIG. 9 is a perspective view of a movable terminal.

The movable terminal 26 shown in FIG. 9 has an armature 56, a movable spring 58 caulked to the armature 56, and two movable contacts 24 caulked to the movable spring 58. In some manufacturing processes of the movable terminal 26, a metal plate before each movable spring 58 is cut is caulked to the armature 56, and then the metal plate is sequentially fed to an automatic cutting machine to cut at a predetermined cutting position 60, so as to form the movable terminal 26. Here, when the cutting position 60 of the movable spring 58 is in contact with the armature 56 as in the example shown in FIG. 9, a jig for cutting the movable spring 58 may interfere with the armature 56, which may make the cutting operation difficult.

Figure 10:
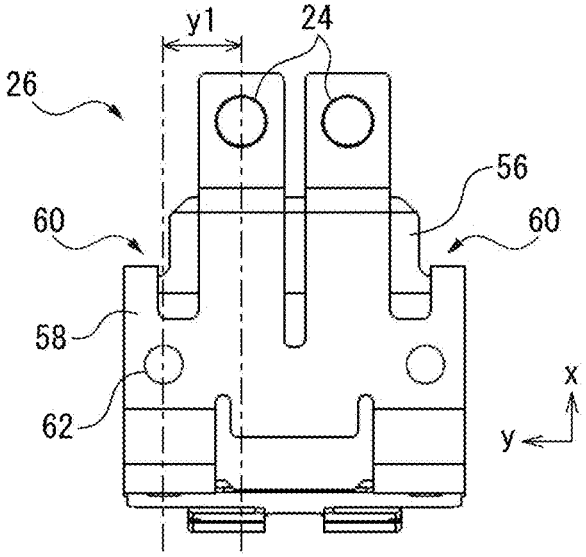
FIG. 10 is a view showing an example of a cutting position of a movable spring.

Therefore, as shown in FIG. 10, the armature 56 has a shape in which both ends in the y-direction are recessed relative to the center thereof. By extending the cutting portion 60 in the x-direction as needed, it is possible to prevent the armature 56 from being exist at the cutting portion 60 of the movable spring 58, thereby suitable cutting cab be performed.

Further, the movable spring 58 may be distorted due to the pressing force when the movable spring 58 is caulked to the armature 56. Here, if the caulking position of the movable spring 58 and the position of the movable contact 24 are aligned in the x-direction, the distortion of the movable spring 58 affects the caulking position of the movable contact 24, thereby the positioning accuracy of the movable contact 24 may be deteriorated.

Therefore, as shown in FIG. 10, a caulking position 62 of the movable spring 58 may not be aligned with the caulking position of the movable contact 24 in the x-direction, e.g., the caulking position 62 may be shifted by a distance y1 from the caulking position of the movable contact 24 in the y-direction, thereby the positioning of the movable contact 24 can be prevented from being adversely affected by the distortion of the movable spring 58 by caulking.

Figure 11:
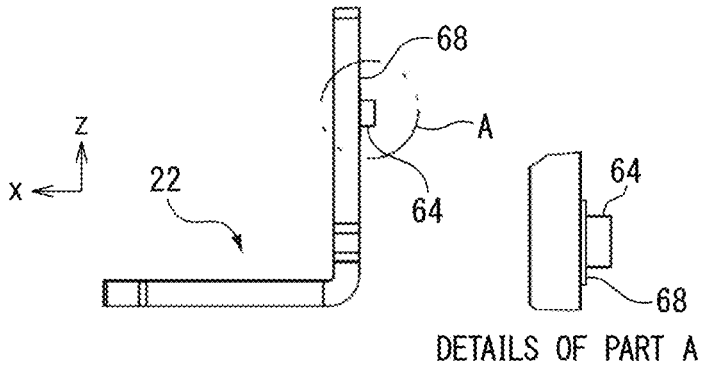
FIG. 11 is a view showing a yoke.

FIG. 11 shows the side surface of the yoke 22 together with a partially enlarged view thereof. The yoke 22 has a protrusion 64 for caulking formed by press molding, etc. By inserting the protrusion 64 into a hole 66 of the movable spring 58 and caulking the protrusion 64, the movable terminal 26 is fixed to the yoke 22. The movable spring 58 made of a relatively thin metal plate may be deformed by the pressing force of the punch when caulking the protrusion 64.

Therefore, as shown in a detailed view of part A in FIG. 11, a step-like bulge portion 68 having a height lower than that of the protrusion 64 may be formed on the yoke 22 at the base of the protrusion 64, thereby the dimensional change in the caulking direction (the x-direction) of the movable spring when the movable contact is caulked can be reduced. As an example, the bulge portion 68 has a height of 20 to 50 micrometers and has a ring shape having an outer diameter larger than a diameter of the protrusion 64 when viewed from the x-direction. The outer diameter of the bulge portion 68 is preferably larger than the outer diameter of the punch when viewed from the x-direction.

Figure 12:
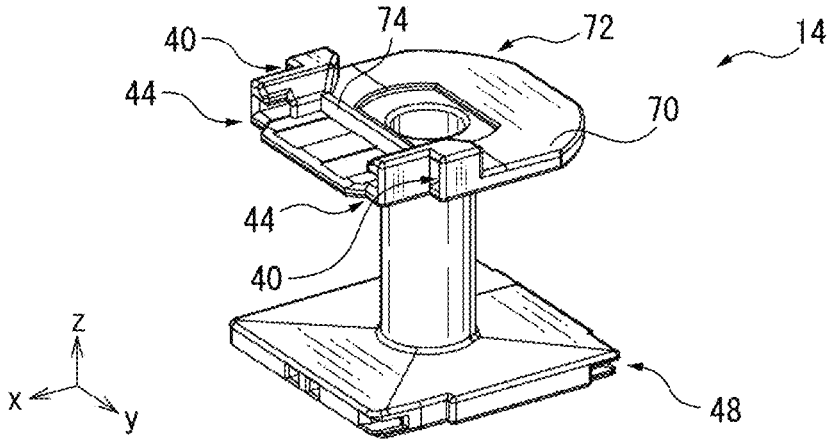
FIG. 12 is a perspective view showing a winding frame.
Figure 13:
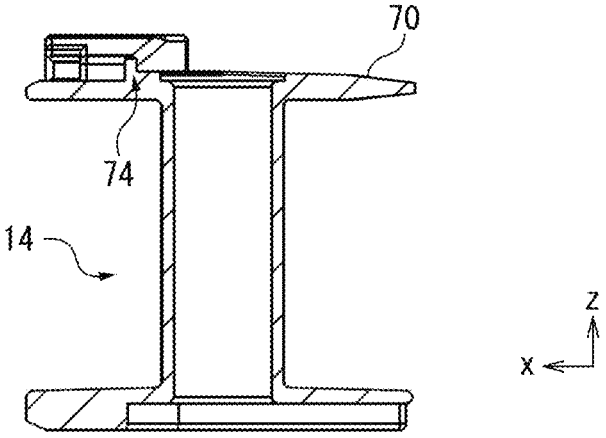
FIG. 13 is a sectional side view of the winding frame.

FIGS. 12 and 13 are a perspective view and a side sectional view of the winding frame 14, respectively. When the winding frame 14 is thinned in order to reduce the size of the relay, a flange 70 formed at the end of the winding frame 14 is warped by the pressure generated by winding the wire around the thin winding frame 14, and the flange 70 may interfere with the armature 56. Therefore, in the example of FIG. 13, the flange 70 has an inswept tapered shape in order to prevent interference between the flange 70 and the armature 56.

The effect of warpage increases as it approaches the outer peripheral portion of the flange 70. For example, as shown in FIG. 12, by forming at least a part of the outer peripheral portion of the flange 70 into a chamfered shape or a rounded shape 72, the possibility of interfering between the flange 70 and the other components can be reduced even if the flange 70 is warped.

When the movable contact and the fixed contact are repeatedly contact with each other, the contacts are worn and metal powder and/or metal scraps are generated. Depending on the mounting direction of the relay and/or external factors such as vibration, the metal powder, etc., may move inside the relay and enter between the armature and the iron core or the yoke, which may cause a malfunction of the relay.

Therefore, in the example of FIG. 12 or 13, between a region where the fixed contact and the movable contact are arranged and a region where the iron core is arranged, a wall 74 configured to divide the two regions is provided so that the metal powder or scraps generated from the fixed contact or the movable contact do not move toward the iron core. In the illustrated example, the wall 74 is formed on the upper end surface of the winding frame 14 as a linear wall having a predetermined width in the y-direction, and may be formed, for example, as a molding wall generated when the winding frame 14 is resin-molded. The wall 74 can efficiently prevent the ingress of the metal powder or scraps, thereby the probability of a malfunction of the relay can be significantly reduced.

Figure 14:
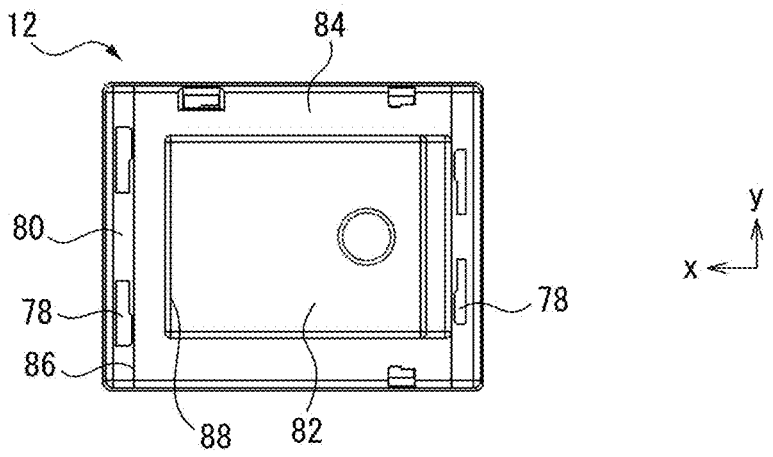
FIG. 14 is a plan view showing a base.
Figure 15:
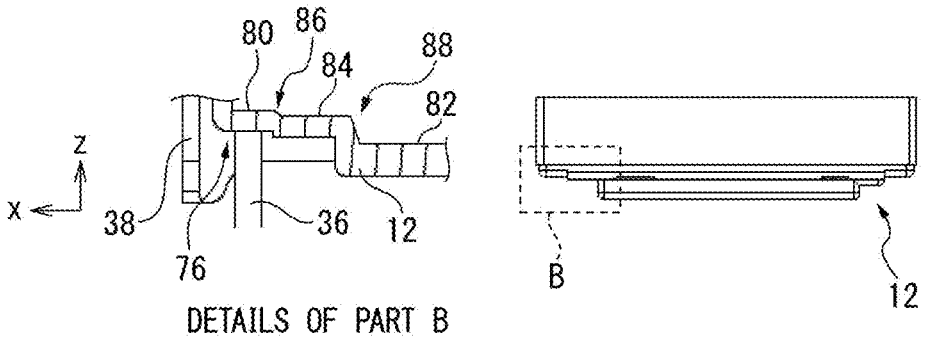
FIG. 15 is a view showing a side and a partial cross-section of the base.

FIGS. 14 and 15 show a structural example of the base 12. The base 12 and each terminal, the base 12 and the cover 38 are adhered to each other by, for example, a thermosetting resin. In order to satisfy the adhesive strength between these members, it is desired that an adhesive layer 76 has a certain depth. Further, it is desired that the lower surface of the base 12 does not contact a substrate (not shown) on which the relay is mounted, in order to shield heat from the substrate. Still further, it is desired to avoid interference between the structures within the relay. After satisfying these requirements, it is desirable that the base 12 itself has a certain level of strength or higher.

In the example of FIG. 14, the region of the inner lower surface of the base 12 is divided into a region 80 for the terminal including an insertion hole 78 into which the terminal is inserted and bonded, a region 82 where the winding frame 14 and the yoke 22 are arranged, and an intermediate region 84 between the regions 80 and 82. Steps 86 and 88 are formed between the respective regions so that the depth of each region is different. By making the region 80 shallower than the region 84, the thickness of the adhesive layer 76 below the region 80 can be increased to increase the adhesive strength. Further, by making the region 82 where the adhesive is not used deeper than the region 84, a larger space for arranging the structure such as the winding frame can be secured. The rigidity of the base itself is increased by providing a taper or rib to the base so that a thin portion are not formed in each part of the base.

Although the embodiments have been specifically described above, the present disclosure is not limited to the above-described embodiments. Various variations and modifications may be made without departing from the scope of the present disclosure.

The invention claimed is:

1. A relay comprising:

an electromagnet having a coil wounded on a winding frame and an iron core positioned in the winding frame;

an armature actuated by activation of the electromagnet;

a movable terminal having a movable spring attached to the armature and a movable contact attached to the movable spring;

a fixed contact opposed to the movable contact; and a yoke to which the movable spring is caulked, wherein the yoke has a protrusion for caulking inserted in the movable spring, and a bulge portion adjacent to the protrusion and having a height lower than a height of the protrusion, and wherein the bulge portion is configured to encompass the protrusion when viewed from a protruding direction of the protrusion.

2. The relay according to claim 1, wherein the bulge portion has a ring shape.

3. The relay according to claim 1, wherein an outer diameter of the bulge portion is larger than a diameter of the protrusion.

4. The relay according to claim 1, wherein an outer diameter of the bulge portion is larger than an outer diameter of a punch for caulking the protrusion.

5. A relay comprising:

an electromagnet having a coil wounded on a winding frame and an iron core positioned in the winding frame;

an armature actuated by activation of the electromagnet;

a movable terminal having a movable spring attached to the armature and a movable contact attached to the movable spring;

a fixed contact opposed to the movable contact; and a yoke to which the movable spring is caulked, wherein the yoke has a protrusion for caulking inserted in the movable spring, and a bulge portion concentric with the protrusion and having a height lower than a height of the protrusion.

* * * * *